United States Patent [19]

Vogel

[11] 4,437,834

[45] Mar. 20, 1984

[54] METHOD OF AND APPARATUS FOR TREATING GRANULAR MATERIAL

[75] Inventor: Alfredo Vogel, Malvern, England

[73] Assignee: Cosworth Research and Development Limited, United Kingdom

[21] Appl. No.: 330,864

[22] Filed: Dec. 15, 1981

[30] Foreign Application Priority Data

Dec. 16, 1980 [GB] United Kingdom ..... 8040281
Nov. 23, 1981 [GB] United Kingdom ..... 8135225

[51] Int. Cl.[3] ..... F27B 15/00; F27B 15/18; F27B 5/02

[52] U.S. Cl. ..... 432/14; 164/5; 164/456; 432/15; 432/17; 432/18; 432/58; 432/207

[58] Field of Search ..... 164/5, 456; 34/13; 432/14, 15, 17, 18, 58, 207

[56] References Cited

U.S. PATENT DOCUMENTS

| | | | |
|---|---|---|---|
| 2,478,461 | 8/1949 | Connolly | 209/3 |
| 3,480,265 | 11/1969 | Deve | 432/15 |
| 3,685,165 | 8/1972 | Deve | 34/57 A |
| 4,106,112 | 8/1978 | Jones | 366/4 |
| 4,304,289 | 12/1981 | McMullen | 164/5 |

FOREIGN PATENT DOCUMENTS

| | | |
|---|---|---|
| 2429169 | 1/1976 | Fed. Rep. of Germany . |
| 332194 | 8/1930 | United Kingdom . |
| 1428422 | 3/1976 | United Kingdom . |
| 1546044 | 5/1979 | United Kingdom . |

*Primary Examiner*—John J. Camby

[57] ABSTRACT

A method and apparatus for treating granular materials which require to be heated to drive off volatile constituents and which require to be cooled, for example foundry sand containing an organic binder. The method comprises the step of maintaining a mass of the material at a treatment temperature lying in the range 240° C.–400° C. for between four and thirty hours. The mass may be initially heated by virtue of a manufacturing process in which the mass has been previously used. Alternatively, the mass may be initially heated by a preheating step such as heating in a fluidized bed. Alternatively, the mass may be heated by being placed in heat transfer relationship with a second mass of the material which has been previously heated, for example, in a fluidized bed. Apparatus for performing the method is also disclosed.

25 Claims, 4 Drawing Figures

METHOD OF AND APPARATUS FOR TREATING GRANULAR MATERIAL

BACKGROUND OF THE INVENTION

1. Field of the Invention

This invention relates to a method of and apparatus for treating granular materials which require to be heated to drive off volatile constituents, and which require to be cooled and, more particularly, but not exclusively, foundry sand containing an organic binder.

2. Description of the Prior Art

Because of rising costs of transport for clean sand deliveries and environmental difficulties associated with dumping, it is becoming increasingly desirable to treat used foundry sand, to convert the used sand, i.e. sand grains covered with spent resin and resin dust, to clean sand for re-use.

A percentage of such used sand can be treated for re-use using only mechanical attrition. However this process does not remove all, and in some cases hardly any, of the resin binder and the presence of the residual spent binder is a problem with some binder systems, particularly the furane resin-peroxide-sulphur dioxide gas hardening system.

The only good reclamation system for such organic binder systems is one in which the organic component is burned off. Conventionally however such systems are gas heated, and because natural gas flames are difficult to sustain at temperatures below 800° C., most existing thermal reclamation systems work in the temperature range 800°-1000° C. Such systems include fluid beds and rotary kilns. These existing processes have high capital investment costs and high energy consumption, in the region of 300 kwh/tonne of sand. Much of this large energy input is required by the cooling systems designed to reduce the temperature of the sand from red hot to about 35° C., at which it can be reused.

U.S. Pat. No. 2,478,461 discloses a method and apparatus in which sand is heated in a furnace to a temperature of from 650° C. to 816° C. and cooled by mixing with cool sand which has been previously so heated and then cooled.

One fluid fired fluid bed reclaimer is known to work at a lower temperature of 500° C., and reclaims satisfactorily, producing a weight loss on ignition of the reclaimed sand below 0.01 wt% and a best performance of 100 kwh per ton. However, it is known to suffer from flame failure and other stability and control problems. It is not easy to run and its floor space requirements are high.

U.S. Pat. No. 3,685,165 discloses a method and apparatus in which sand to be reclaimed is passed via a plurality of pre-heating chambers to an electrically heated chamber where the sand is at a temperature of about 650° C. and then discharged via a series of cooling chambers, heat from the sand in the cooling chambers serves to heat the sand in the pre-heating chambers.

U.S. Pat. No. 3,480,265 discloses a method and apparatus in which previously reclaimed sand is heated to 593° C. in a fluidised bed and then used sand is added to the bed so as to be heated to 593° C. to burn off carbonised resin material. The hot thus reclaimed sand is then discharged. The bed can be electrically or fluid fuel heated.

These previous methods are all methods of treating granular material which comprise a step of maintaining a first mass of said granular material at a treatment temperature for a time sufficient to achieve desired temperature of the material wherein the treatment temperature is at least 593° C. and suffer from the disadvantages discussed above.

SUMMARY OF THE INVENTION

The present invention is intended to overcome these disadvantages by arranging that the treatment temperature lies in the range 250° C.-400° C. and that said time is at least 4 hours since we have found that good reclamation is achieved by treatment at such temperature and times contrary to prior practice proposals and expectations.

The treatment temperature may lie in the range 250° C. to 350° C.

Preferably the treatment temperature lies in the range 300° C. to 400° C.

More preferably, the treatment temperature lies in the range 300° C. to 350° C.

The treatment time may lie in the range 4–30 hours and may lie in the range 4–24 hours.

It has been found that no mixing or agitation of the material is required, the desired reclamation occurring solely due to residence of the material at the above mentioned temperature and for the above mentioned time. There is therefore no need to provide any mechanical mixing or agitating device in apparatus for performing the method.

The mass of material being treated may lie in the range 20 to 100 tons. Usually where the material is silica sand, the mass lies in the range 20 to 50 tons and where the material is zircon sand, the mass lies in the range 20 to 100 tons but other relatively large masses may be used if desired.

In one aspect, the first mass may be initially heated to sand treatment temperature by virtue of a manufacturing process in which the mass has been previously used. The manufacturing process may be a metal casting process, such as iron casting wherein the metal casting temperature and metal-to-granular material ratio is such that the first mass is heated so as to be at said treatment temperature.

In a second aspect, the first mass may be initially heated to said treatment temperature by a pre-heating step in which the first mass is placed in heating relationship with a heat source.

The heat source may be an electric head source.

The first mass may be fluidised whilst being heated.

The first mass may be initially heated to a temperature lying in the range 600° C. to 250° C.

Where the granular material is sand containing an organic binder, the fluidising gas, such as air, may provide an oxidant for burning off some of the organic binder in the sand in the case where the temperature to which the first mass is initially heated lies in the range 600° C. to 430° C.

Where the temperature to which the first mass is initially heated is below 430° C. little or no reclamation or removal of binder occurs during the initial heating step.

In a third aspect, the first mass may be initially heated by placing it in heat transfer relationship with a second mass of said material at a temperature above said treatment temperature so that the temperature of the first mass is raised to said treatment temperature.

In the third aspect the method may comprise the steps of heating a second mass of said granular material to a temperature above a first predetermined temperature, maintaining the second mass above said first predetermined temperature for at least a first predetermined time to treat the second mass of material, feeding at least part of said second mass, whilst at a temperature above a second predetermined temperature, into heat transfer relationship with said first mass of granular material to heat said first mass to the treatment temperature which is above a third predetermined temperature, and maintaining the first mass above said third predetermined temperature for at least a second predetermined time to treat the first mass.

Where the second mass is fed so that there is little or no heat loss, after heating to the first predetermined temperature, before the mass is fed into said heat transfer relationship with the first mass, the second predetermined temperature will be only slightly below or the same as, the first predetermined temperature; but if the feed is such that there is substantial heat loss, then the second predetermined temperature may be substantially below the first predetermined temperature.

The second mass is preferably heated using electric heating means.

The second mass is preferably fluidised whilst it is at said temerature above said first predetermined temprature. Where the granular material is sand containing an organic binder, the fluidising gas, such as air, may provide an oxidant for burning off the organic binder in the sand.

The high temperature in the fluidised bed produces decomposition of the resin and therefore improves the efficiency of combustion. The lack of a gas-air mixture burning and producing still more fumes and steam can be completely avoided by the use of electric heating means. The high burning efficiency ensures that there are no smoke emission problems, and the use of immersed heating elements ensures maximum thermal efficiency.

In both the second and third aspects, the fluidisation is preferably accomplished by sparge tubes. This simplifies the engineering associated with introducing air through a membrane or diaphragm, and enables better control of fluidisation with smaller volumes of air, significantly reducing air loss from the system.

In the third aspect, all of the second mass may be fed into heat transfer relationship with the first mass. Said feeding into heat transfer relationship may comprise mixing the, or said part of the, second mass with the first mass.

The first and second masses are mixed in a preset ratio depending on the temperature of the fluidised bed. Slow reclamation of the first mass then takes place. This reaction goes effectively to completion at 300° C. after approximately 24 hours for furnane polymer resins. However less than complete burning occurs in much shorter times and is sometimes satisfactory, since only a percentage of the sand is thus slightly less than perfectly reclaimed.

The first and second masses may be at a temperature below a fourth predetermined temperature at the end of treatment of the first mass.

Said first predetermined temperature may lie in the range 430°–600° C. and preferably 440° to 500° C. and more preferably 450° to 470°.

Said second predetermined temperature may lie in the range 250° C. to 600° C.

Said third predetermined temperature may lie in the range 250°–400° C. and may lie in the range 300° to 400° C. or 250° to 350° C., and preferably 300° to 350° C.

Said fourth predetermined temperature may lie in the range 35°–40° C.

Said first predetermined time may lie in the range 0.1 hours to 1 hour.

Said second predetermined time may lie in the range 4 hours to 30 hours and preferably 4 to 24 hours.

The first mass may be up to 50% of the second mass and is conveniently controlled by means of a thermocouple provided to sense the temperature of the first and second masses when in heat transfer relationship to ensure that the temperature thereof does not fall below said third predetermined temperature.

The first mass may be 25wt.% to 50wt.% of the second mass.

The method may be a continuous process whereby a second mass of granular material is continuously fed through a first treatment station where it is raised to said temperature above a first predetermined temperature and maintained at said temperature for said first predetermined time, and continuously fed therefrom and into heat transfer relationship with a continuously fed first mass of sand in a second treatment station where the first mass is treated by being raised to a temperature above said third predetermined temperature and maintained thereat for said second predetermined time and treated sand is continuously fed from said station.

The hot fluidising air may be fed into heat transfer relationship with used sand to be treated as it is fed to provide said second mass.

The first and second masses may be cooled to said temperature below a fourth predetermined temperature by feeding cooling air into heat transfer relationship therewith and said cooling air may thereby be heated and then fed to provide said fluidising gas.

The mixing of the two streams of sand according to the third aspect of the invention provides the advantages of:

(i) reclaiming more sand without further expenditure of energy (only a little time, and with extra sand tied up in the system, which represents a minimal cost); and (ii) the cooling of the sand from a temperature in excess of 500° C. to about 300° C. without waste or expenditure of energy. The cooling of sand from 300° to 35° C. involves simpler and cheaper engineering materials and processes, than when having to deal with sand requiring cooling from 800° C. or above, such as is required with the prior system hereinbefore referred to.

According to another aspect of the invention we provide an apparatus for treating granular material comprising a first treatment station, and means to maintain a first mass of said granular material at said station at a treatment temperature lying in the range 250°–400° C.

The treatment temperature may lie in the range 250° C. to 350° C.

Preferably the treatment temperature lies in the range 300° to 400° C.

More preferably, the treatment temperature lies in the range 300° C. to 350° C.

Since, as mentioned above, no mixing or agitation of the material is required, there is no need to provide any mechanical mixing or agitation devices in the apparatus thereby reducing cost.

The first treatment station may comprise a container of tonnage volume.

The volume may be sufficient so that the mass of material being heated lies in the range 20 to 100 tons and where the material is silica sand the volume may be such that the mass of sand may lie in the range 20 to 50 tons, and where the material is zircon sand the volume may be such that the mass lies in the range 20 to 100 tons.

The container may be thermally insulated and/or a heat source may be provided to compensate for heat loss.

In one aspect the apparatus includes means to feed said first mass at a temperature above said treatment temperature from a manufacturing process to said first treatment station.

The apparatus may include a metal casting plant, including a knock-out means, a means to feed knocked-out material to said first treatment station.

In a second aspect the apparatus may include a preheating station having means to place said first mass in heating relationship with a heat source.

The heat source may be an electric heat source.

The apparatus may include means to fluidise said first mass whilst it is being heated.

In a third aspect the apparatus may comprise means to heat a second mass of said granular material to a temperature above said treatment temperature and means to feed the second mass into heat transfer relationship with the first mass to heat the first mass to said heat treatment temperature.

In the third aspect, the apparatus may comprise a second treatment station, means to heat the second mass of granular material at said station to a temperature above a first predetermined temperature, means to feed granular material to and from said station so that it is maintained at said temperature above a first predetermined temperature for at least a first predetermined time to treat the second mass of material at said station, means to feed at least part of said second mass, whilst at a temperature above a second predetermined temperature, into heat transfer relationship with the first mass of material to heat said first mass to a temperature above a third predetermined temperature at the first treatment station, means to feed said first and second masses of material from said first treatment station at a rate such that the first mass is maintained at said treatment temperature above said third predetermined temperature for at least a second predetermined time to treat the first mass of sand.

The means to feed the second mass into heat transfer relationship with the first mass may comprise mixing means whereby the second mass is mixed with the first mass.

Said feed means for the first and second masses may operate continuously.

The second treatment station may comprise a container to which said second mass is fed and means to fluidise said second mass when in said container.

The first treatment station may comprise a container to which both said first and second masses are fed.

A heat exchanger may be provided at the exit of the first treatment station wherreby material leaving the station is cooled to a temperature below said fourth predetermined temperature.

The heat exchange means may include means to feed cold air in heat transfer relationship with said first and second masses and said cold air may be thereby heated and means may be provided to feed said heated air to said second treatment station to provide air for fluidising sand therein.

The air which has fluidised the second mass of sand at the second treatment station may be fed into heat transfer relationship with incoming material, which is to provide said second mass, as the air leaves said second treatment station.

Said apparatus may comprise a storage hopper having two outlets, means to feed sand to provide said second mass from one outlet and means to feed sand to provide the first mass from the other outlet.

The storage hopper may be positioned above the second treatment station which may be positioned above the first treatment station.

The placing of the units vertically one above the other reduces ground space requirements to approximately one tonne per hour per square meter.

By designing the system with sufficient excess capacity, the unit can work overnight, taking advantage in some countries and tariffs to cheap rate electricity, and thus reducing the cost per tonne of reclamation to one-half or one-third of normal rates.

BRIEF DESCRIPTION OF THE DRAWINGS

The invention will now be described in more detail, by way of example, with reference to the accompanying drawings wherein.

and

Figure 4:
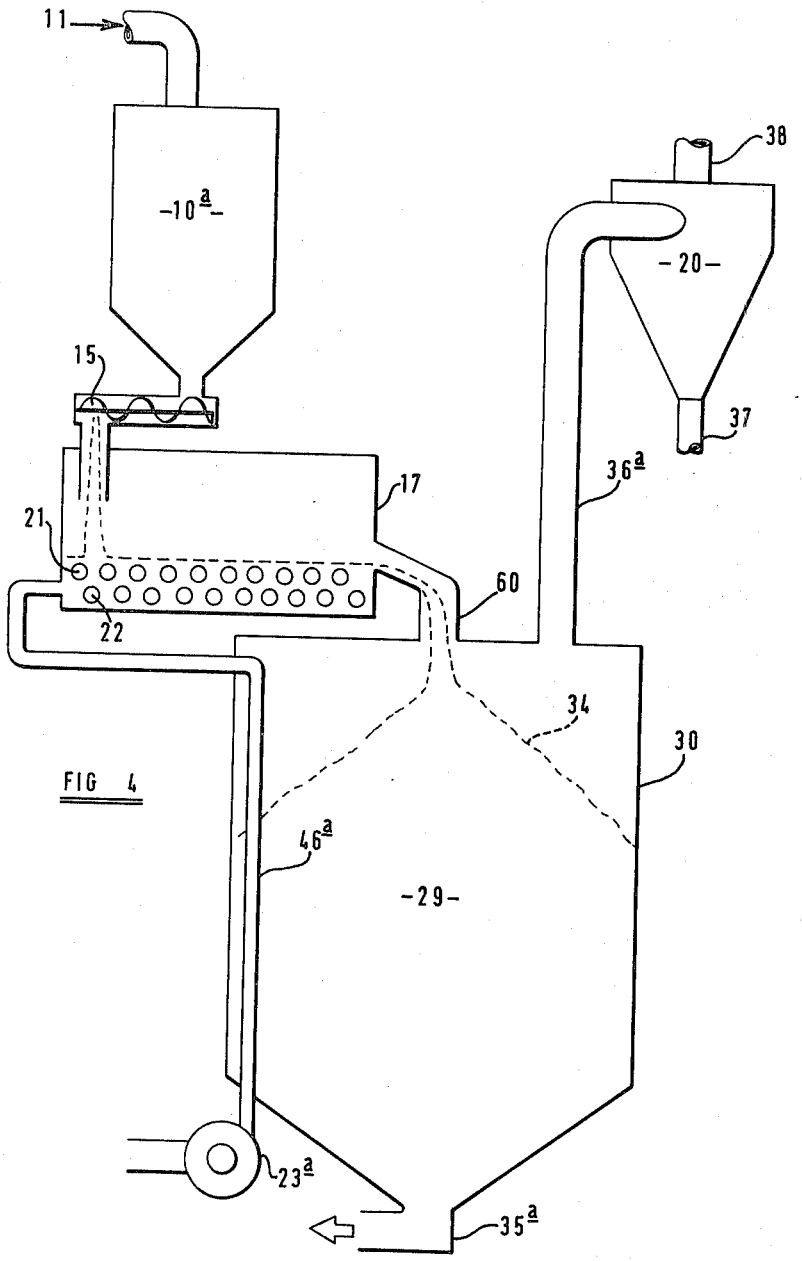

FIG. 4 is a diagrammatic cross-sectional view of a still further apparatus embodying the invention and in which a still further method embodying the invention can be performed.

DESCRIPTION OF THE PREFERRED EMBODIMENTS

Figure 1:
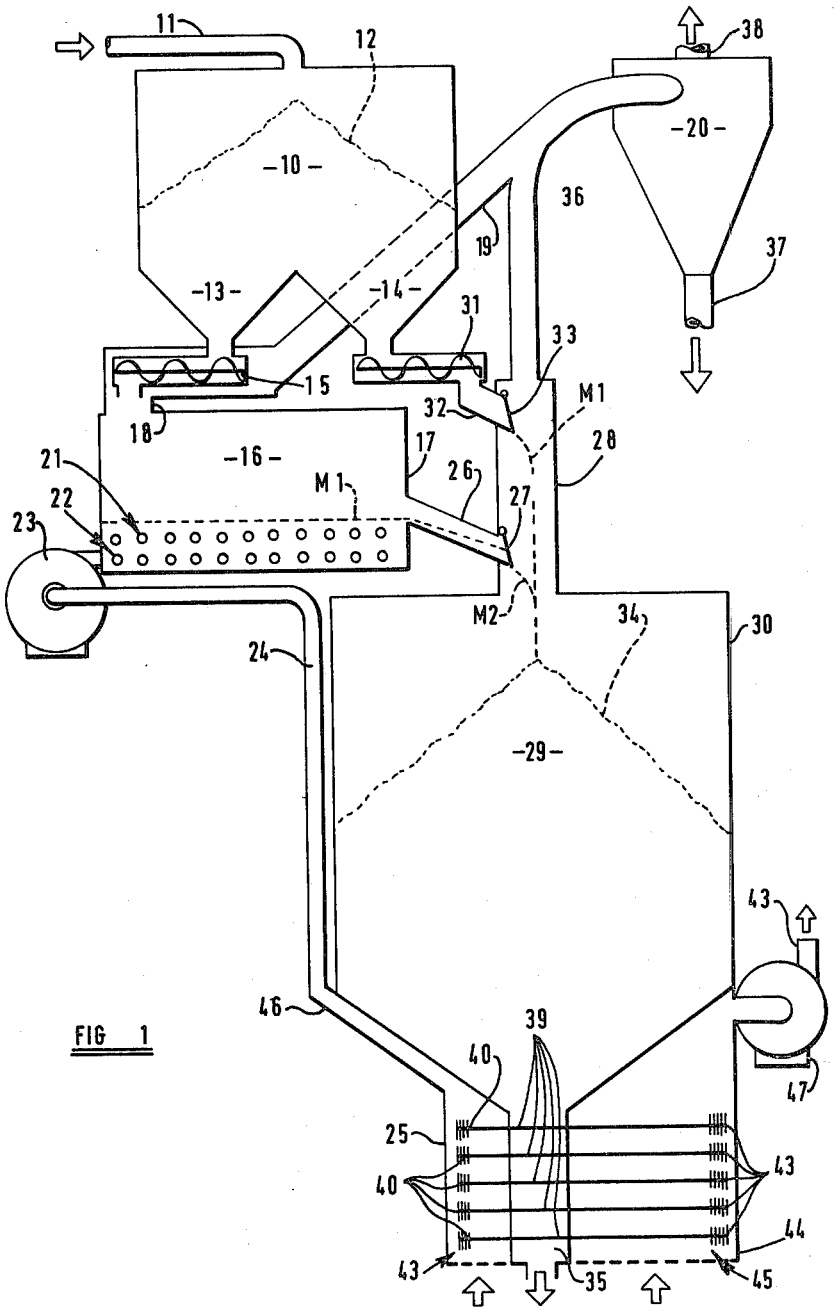
FIG. 1 is a diagrammatic cross-sectional view of an apparatus embodying the invention and in which a method embodying the invention can be performed.

Referring to FIG. 1, an apparatus for treating used foundry sand containing a resin binder, in particular a furane polymer resin, comprises a closed hopper 10 to which a feed conduit 11 extends through which used foundry sand is conveyed, by means not shown, for storage in the hopper 10 as indicated at 12. At its lower end the hopper 10 is provided with two outlet means 13, 14.

The outlet 14 of the storage hopper 10 is provided with a screw conveyor 31 which feeds a first mass of used sand from the hopper 10 at a predetermined rate via a discharge chute 32 and a flap valve 33 to a first treatment station 29 in the form of an after burner silo or container 30.

The outlet 13 is provided with a screw conveyor 15 to feed a second mass of the used sand 12 from the hopper 10 at a predetermined rate. The screw conveyor 15, in use, conveys the sand to a treatment station 16 comprising a container 17. A duct 18 extends from the top of the container 17 around the exterior of the screw conveyor 15 and is connected by a duct 19 to a cyclone 20, or other device, where dust and fines are extracted.

Within the container 17 of the second treatment station are provided a plurality of electrical heating elements 21 contained within protective stainless steel tubes mounted by sliding joints in the steel shell of the container 17 thereby to allow for thermal expansion of the tubes. In addition a plurality of sparge tubes 22 are provided welded into the shell and air is fed to the sparge tubes 22 by a fan 23 which draws air via a duct 24 from a heat exchanger 25, to be described in more detail hereinafter.

In use, the air fed by the fan 23 into the sparge tubes 22 fluidises the second mass M2 of used sand within the container 17 and the sand is heated by the elements 21, which are at a temperature of 800° C. to a temperature lying in the range 430°-600° C. Preferably the temperature lies in the range 440°-500° C. and optimally 450°-470° C.

Sand overflows from the thus fluidised bed via a dicharge chute 26 provided with a flap valve 27 at its ingress into a conduit 28 which communicates with the first treatment station 29.

The rate of feed provided by the conveyors 15 and 31 is arranged so that the cold first mass of sand issuing from the chute 32 is mixed with the hot treated sand issuing from the chute 26 in a predetermined ratio. Typically the ratio lies in the range 2 to 4 parts substantially of sand to one of cold sand and the thus mixed sand is stored in the silo 30 as indicated at 34.

The silo 30 is fitted with integral tubes, baffles or the like to reduce sand segregation in conventional manner.

Because of the short distance between the interior of the container 17 and the interior of the container 30, there is relatively little heat loss and so the above referred to second predetermined temperature is only up to about 10° C. lower than the first predetermined temperature, i.e. the temperature in the container 17. If desired, the container 17 could be at a location remote from the container 30 in which case there would be a considerable difference between the first and second predetermined temperatures, and thermal insulation and, if necessary, auxiliary heating means, would be arranged to ensure that the necessary second predetermined temperature is achieved.

The temperature of the hot second mass of sand and the ratio of admixture are arranged so that the mixture 34 of first and second masses contained in the silo 30 is at a temperature lying in the range 250°-400° C. Means, not shown, are provided to withdraw the mixture 34 from the silot 30 via an exit conduit 35 at such a rate that the mixture dwells within the silo 30 for a sufficient time for adequate treatment of the first mass. Typically, the dwell time lies in the period four to twenty four hours.

Oxygen for the slow combustion process occurring within the silo 30 of the sand therein is obtained from air precolating through the mass of sand 34 in the silo 30 rising from the exit 35 and which is removed by an updraught through a conduit 28 and extension part 36 thereof which joins the duct 19 and thus passes to a cyclone or other device 20. The extracted dust fines and the like are withdrawn, as indicated at 37, whilst the invisible fumes are discharged to atmosphere as indicated at 38.

The exit conduit 35 of the silo 30 is provided with a plurality of transversely extending heat pipes 39 which project from opposite sides of the conduit 35. On one side, indicated at 40, they are enclosed within a casing 41 to provide a first heat exchanger 25, whilst on the opposite side, indicated at 43, they are contained within a casing 44 to provide a second heat exchanger 45. The casing 41 of the first heat exchanger 25 is connected by a duct 46 to the duct 24 communicating with the fan 23, so that, in use, cold air is drawn into the casing 41 to cool the sand emerging from the discharge conduit 35 and the air, which has thereby become heated, is drawn by the fan 23 to provide the fluidising air for the first treatment station 16. The air is further heated therein by the heating elements 21 and the thus heated air is passed, in counterflow, around the conveyor 15 within the duct 18 and is thereby cooled to pre-heat the incoming first mass of sand.

Ideally, the system is run so that the air discharged into the atmosphere by the discharge duct 38 of the cyclone 20 has given up a major proportion of the heat it has gained to the incoming sand in the "sand preheater" provided by the duct 18 surrounding the conveyor 15, and so that the sand is discharged through the conduit 35 at such a rate that the first heat exchanger 25 can alone transfer all the necessary heat from the sand into the incoming air to provide the fluidising air.

However, at times when high output is demanded, or when transient surges of demand occur, the capacity of the fluidising air to absorb this extra heat is exceeded. For this reason the second heat exchanger 45, which has a capacity of five to ten times that of the heat exchanger 42, is brought into action by arranging that a fan 47 is automatically started when the temperature of the sand being discharged through the conduit 35 exceeds 35° C. The air discharged from the outlet 48 of the fan 47 is, of course, warm and clean and can be conveniently used for space heating of the foundry or for heating water or other purposes.

The construction of the heat exchangers 25 and 45 using heat pipes simplifies control, running and maintenance, as well as giving the system considerable capacity for dealing with surges. The plant is lagged and insulated in conventional manner to further conserve heat.

In use, used foundry sand is fed along the feed conduit 11 into the storage hopper 10 where first and second masses of used sand are continuously fed therefrom in a predetermined ratio by the conveyors 31 and 15.

The ratio is determined having regard to the temperature of the second mass of sand and the time available for the mixture of first and second masses to dwell in the second treatment station in accordance with the following formula:

$$X = \frac{(T - t)}{(T - 20)} 100\%$$

where

X=the percentage of the first mass expressed in terms of wt.% of the second mass.

T is the temperature in °C. of the second mass immediately before it is mixed with the first mass.

t is the average temperature in °C. of the mixture, after equilibrium has been reached, in the first treatment station.

If, for example, T=400° C. and it is desired that the mixture does not drop below 350° C., i.e. t=350° C., to ensure thorough burning in a short time, then X=13.15%.

If T=500° C. and t=350° C. then X=31.25%.

If T=500° C. and several hours can be allowed for the dwell time so that t can be 300° C. then X=41.67%.

If T=600° C. and t=300° C. then X=51.72%

Under certain circumstances, where some loss of quality of the sand and possibly some fuming is permissible, X may = 100% since it is possible to operate the second treatment station at a temperature, t of approximately 250°-260° C.

The sand fed by the conveyor 15 to provide the second mass is fed to the second treatment station 16, and is pre-heated by the hot fluidising air emerging via the duct 18. When in the container 17, the sand is fluidised and further heated to a temperature lying in the range 430°-600° C. and preferably 440°-500° C. and optimally 450°-470° C. which is sufficiently high to burn off the resin and to thereby clean the sand. The overflow from the bed leaves via the discharge chute 26 and enters the silo 30 where it is mixed with the cold first mass of used sand being fed by the conveyor 31. The mixing cools the hot second mass and heats the cold first mass, which is typically at a temperature lying in the range 0° C. to 50° C., so that they attain a temperature lying in the range 250°-400° C. and preferably 300°-350° C. The rate of withdrawal of the mixture from the silo 30 is such that the sand has a dwell time within the silo of four to thirty and preferably four to twenty four hours which is adequate to ensure the desired amount of treatment of the cold second mass.

As the mixture is withdrawn from the bottom of the silo 30, it is cooled by, usually, the first heat exchanger 42, the air heated thereby serving to fluidise the sand in the second treatment station 16.

The temperatures described above are the theoretical temperatures desired. In practice both temporal and spatial temperature variations occur. For example in the fluidising bed temperatures are known to fluctuate temporally generally within the range ±5° C. but under certain circumstances a wider variation can occur.

Spatial temperature variation can also occur and for example it is generally found that the sand is 5° C. cooler near the fluidising sparge tubes and of course the non-fluidised sand beneath the sparge tubes will be progressively cooler still towards the base of the body of the vessel.

The temperature in the silo 30 will be somewhat lower than that indicated by the thermal balance equation above. It will also fall with time so that after, for example, a week-end, the temperature may fall by as much as 100° C. During continuous operation however, the temperature at the top of the silo can be expected to be within approximately 10°-20° C. of the predicted value whilst near the base might be 20°-50° C. lower. Of course, the rate of fall in temperature will accelerate through the heat exchanger region to give a final exit temperature in the region of 35°-40° C.

In the present example, the method is operated so that there are 24 tons of sand in the container 30 and sand is added to and withdrawn from the container at the rate of one tonne per hour so that a dwell time of 24 hours is achieved within the container 30.

When running at one tonne per hour of sand withdrawn from the discharge conduit 35, the total energy requirements are in the region of 50 kw with the first treatment station 16 running at a temperature lying in the range 430°-600° C. and preferably 440°-500° C. and optimally 450°-470° C., and when mixing cold sand, i.e. the first mass with the hot second mass, in the ratio of 2-4 parts of hot sand to one part of cold sand and with the second treatment station 29 operating at a temperature of 250°-300° C. The treated sand emerging at a temperature lying in the range 35°-40° C. has a loss on ignition value below 0.01 wt%.

Figure 2:
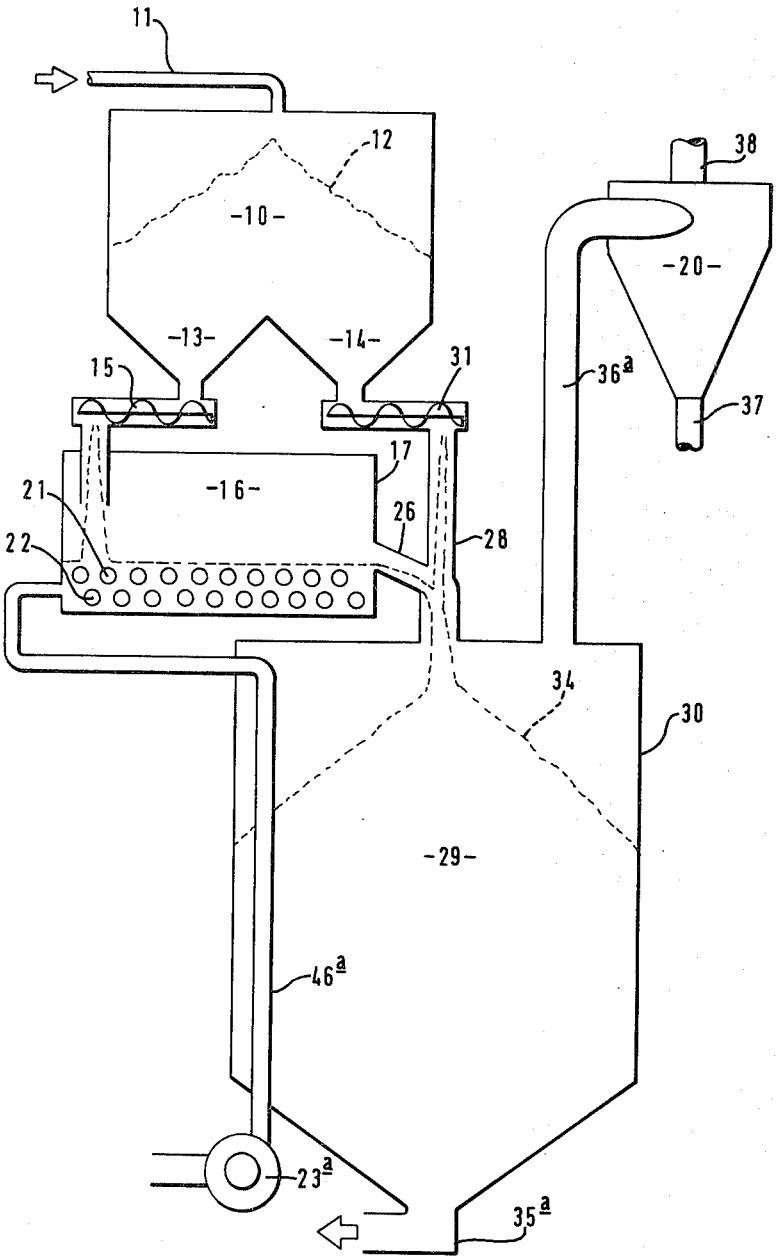
FIG. 2 is a view similar to that of FIG. 1 showing a modification.

In a modification, illustrated in FIG. 2 in which the same reference numerals are used to refer to similar parts as are used in FIG. 1, the ducts 18, 19 and extension part 36 are omitted and the discharge chute 26 and screw conveyor 31 discharge directly into the conduit 28 without the provision of flap valves 27 and 33, and the conduit 28 is closed at its upper end. In this embodiment, a conduit **36*a* is provided extending directly from the silo 30 to the cyclone 20. This has the advantage that fines separate out from the air which is to enter the conduit 36*a* in the top of the silo 30 and so remain therein thereby reducing the load on the cyclone 20**.

The fan 23 is re-sited, as shown at **23*a*, and the duct 46 is routed through the body of the silo 30 as illustrated at 46*a*. This avoids thermal loss from the duct 46*a*** and further heats the air prior to it being used for fluidising the bed.

The sand leaves the silo 30 via an exit conduit **35*a* and is fed thereby to a heat exchanger, not shown, where the sand is cooled to a temperature lying in the range 35° C. to 40° C. The heat exchanger may be of any desired type and may be similar to that illustrated in FIG. 1**.

Oxygen for the slow combustion process in the container 30 is obtained from air percolating through the mass of sand in the container and entering the container through the exit **35*a* and is removed by an updraught through the conduit 36*a***.

Of course, in this and the other embodiments herein described, other combustion supporting gas may be provided if desired and introduced into the container by other means. For example, oxygen can be fed into the container from storage cylinders via nozzles around the the lower end of the container 30.

Table 1 below sets out the operating conditions in respect of a number of reclaiming operations carried out on silica or zircon sand which had been used to manufacture castings. After treatment under the conditions set out in Table 1, the sand was re-used and found to produce high quality moulds. The reclaiming operations of Table 1 were carried out using the method and apparatus of FIG. 1.

TABLE 1

| Temp. in fluid bed °C. | Average Temp. in Container °C. | Dwell time in Container Hrs. | Final Temp. °C. | Sand | X % |
|---|---|---|---|---|---|
| 599 | 399 | 4.5 | 40 | Si | 34 |
| 473 | 347 | 11 | 38 | Si | 27 |
| 448 | 324 | 20 | 36 | Zr | 28 |
| 439 | 301 | 24 | 35 | Si | 33 |
| 431 | 252 | 30 | 35 | Zr | 43 |

Table 2 below sets out the operating conditions in respect of a number of reclaiming operations carried out on silica or zircon sand which had been used to manufacture castings. After treatment under the conditions set out in Table 2, the sand was re-used and found to produce high quality moulds. The reclaiming operations of Table 2 were carried out using the method and apparatus of FIG. 2.

TABLE 2

| Temp. in fluid bed °C. | Average Temp. in Container °C. | Dwell time in Container Hrs. | Final Temp. °C. | Sand | X % |
|---|---|---|---|---|---|
| 590 | 392 | 5 | 40 | Si | 34 |
| 510 | 345 | 11 | 39 | Si | 33 |
| 475 | 335 | 19 | 36 | Zr | 30 |
| 450 | 315 | 23 | 36 | Zr | 31 |
| 430 | 270 | 29 | 35 | Si | 39 |

Although a continuous process has been described above, if desired the process may operate as a batch process.

If desired, instead of all of the second mass of sand treated at the first treatment station being mixed with the first mass, only a part thereof may be so mixed.

It has been found that there is an increase in the overall efficiency of the method and apparatus described with reference to the figure as the temperature in the fluidised bed falls and consequently the amount of the second mass falls to zero. Thus, the method and apparatus of the present invention may be utilised both where a relatively large amount of second mass is added to a first mass as described with reference to the drawings, and also where no second mass whatsoever is added as well as any desired intermediate ratio of first mass to second mass.

Figure 3:
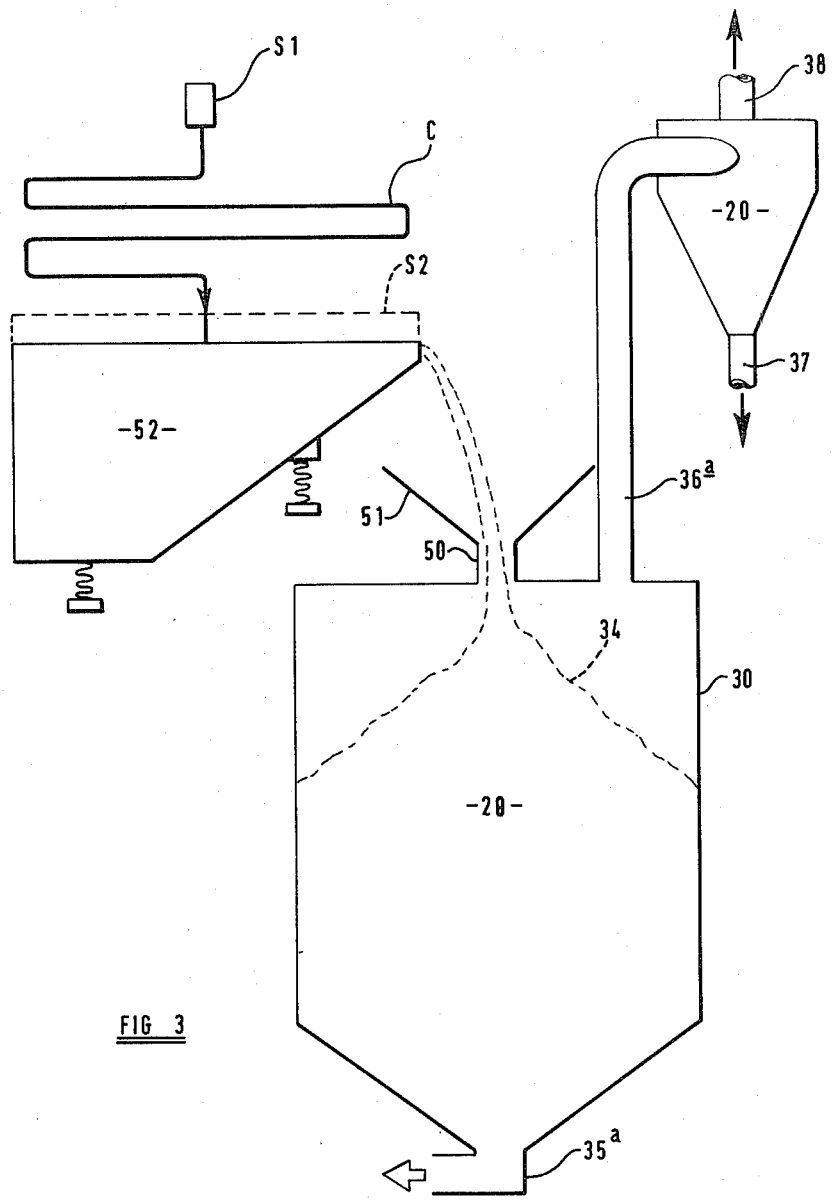
FIG. 3 is a diagrammatic cross-sectional view of another apparatus embodying the invention and in which another method embodying the invention can be performed.

In the case where no second mass of sand whatsoever is fed to the first mass, a considerably more simple apparatus may be provided in that the fluidised bed 16 and associated feed means for sand and air may be omitted. In this case, the second mass is heated to the treatment temperature lying in the range 250°–400° C. for example by virtue of having been used in a previous manufacture operation, for example a ferrous metal casting operation, where the metal reaches a temperature of 1300° C. and sand-to-metal ratios are of the order of 3:1 which results in the knocked-out sand having a temperature in the region of 300° C. Such an apparatus is shown in FIG. 3 where the same reference numerals are used to refer to similar parts as are used in FIGS. 1 and 2. It will be seen that the container 30 and cyclone 20 are as described with reference to FIG. 2. Sand is fed to the interior of the container 30 through a duct 50 leading from a hopper 51 into which the sand is fed from an attrition unit 52 of conventional nature into which sand is fed from a shake-out 51 to which filled moulds are fed from a casting plant 52 along a cooling conveyor.

Because of the direct feed from the attrition unit 52 to the container 30, the temperature of the sand at the attrition unit is only slightly above the temperature in the container 30. If a feed means over a longer distance is necessary, as a result of location of the attrition unit remote from the container 30, the temperature of the sand entering the container would be lower than that from the attrition unit and thermal insulation and possibly auxiliary heating means may be necessary to avoid excessive cooling.

Table 3 below sets out the operating conditions in respect of a number of reclaiming operations carried out on silica sand which had been used to manufacture castings. After treatment under the conditions set out in Table 3, the sand was re-used and found to produce high quality moulds. The reclaiming operations of Table 3 were carried out using the method and apparatus of FIG. 3.

TABLE 3

| Temp. at Attrition Unit °C. | Av. Temp. in Container °C. | Dwell time in Container Hrs. | Final Temp. °C. | Sand |
|---|---|---|---|---|
| 356 | 348 | 11 | 39 | Si |
| 309 | 303 | 24 | 36 | Si |
| 304 | 298 | 25 | 35 | Zr |
| 269 | 265 | 29 | 35 | Si |
| 254 | 251 | 30 | 35 | Zr |

Alternatively, some pre-heating means may be provided to pre-heat the first mass of sand. This pre-heating means may be as desired, for example an electric pre-heating means and may for example comprise a fluidised bed arrangement similar to the bed 16. Such an apparatus is shown in FIG. 4 where again the same reference numerals are used as are used in connection with FIGS. 1 and 2 to refer to similar parts, and as will be seen again the container 30 and cyclone 20 are as described with reference to FIG. 2.

Table 4 below sets out the operating conditions in respect of a number of reclaiming operations carried out on silica or zircon sand which had been used to manufacture castings. After treatment under the conditions set out in Table 4, the sand was re-used and found to produce high quality moulds. The reclaiming operations of Table 4 were carried out using the method and apparatus of FIG. 4.

TABLE 4

| Temp. in Fluid Bed °C. | Av. Temp. in Container °C. | Dwell time in Container Hrs. | Final Temp. °C. | Sand |
|---|---|---|---|---|
| 406 | 396 | 5 | 39 | Si |
| 358 | 350 | 10 | 38 | Si |
| 334 | 327 | 19 | 36 | Zr |
| 305 | 299 | 25 | 36 | Zr |
| 256 | 253 | 30 | 35 | Si |

In this embodiment, sand is fed to the interior of the container 30 along a duct 60 which leads from a container 17 in which a fluidised bed is provided having sparge tubes 22 and electrical heating elements 21 as described with reference to FIG. 1. Sand is fed into the container 17 by a screw conveyor 15, again as described with reference to FIG. 1, from a hopper 10*a*. Of course, in this embodiment the whole of the contents of the hopper 10*a* are fed into the container 17 and then into the container 30. In this case, the first mass may be heated to a temperature lying in the range 250°–400° C. in the fluidised bed in which case little or no reclamation occurs in the fluidised bed or may heated to a higher temperature, for example up to 600° C. in which case reclamation of the sand occurs in the fluidised bed, and the extent of reclamation depends on the dwell time of the sand in the bed. With the apparatus illustrated, the temperature of the sand entering the container 30 is only slightly below the temperature in the fluid bed. If it is necessary to feed the sand over a greater distance, for example as a result of location of the container 17 remote from the container 30, suitable thermal insulation and/or auxiliary heating means may be necessary to prevent excessive cooling of the sand.

Although the case of a granular material comprising used foundry sand containing one particular type of resin binder has been described, the invention may be applied to other materials such as used foundry sand containing other organic binders such as linseed oil, cereals etc., or to other granular material, for example, to dry moist sand or salt.

I claim:

1. A method of reclaiming used foundry sand containing an organic binder comprising the steps of separating a mass of said sand from castings, placing the mass of sand in a stationary container and providing a supply of combustion supporting gas to the container wherein to reclaim the sand the mass of sand is maintained without agitation in the container whilst permitting the gas to percolate through the sand and whilst the sand is held in a treatment temperature range of 250° C. to below 400° C.

2. A method according to claim 1 wherein said treatment temperature range is 300° C. to 350° C. and the treatment time lies in the range of 4 to 24 hours.

3. A method according to claim 1 wherein the mass is initially heated to said treatment temperature range by virtue of a metal casting process in which the mass has been previously used to make moulds into which molten metal has been cast.

4. A method according to claim 1 wherein the mass is initially heated to said treatment temperature range by a pre-heating step in which the mass is placed in heating relationship with a heat source.

5. A method according to claim 4 wherein the mass is fluidised whilst being heated.

6. A method according to claim 1 wherein the mass is initially heated by placing it in heat transfer relationship with a second mass of sand so that the temperature of the first mass is raised to said treatment temperature.

7. A method according to claim 6 wherein the method comprises the steps of heating the second mass of sand to a temperature above a first predetermined temperature, maintaining the second mass above said first predetermined temperature for at least a first predetermined time to treat the second mass of sand, feeding at least part of said second mass, whilst at a temperature above a second predetermined temperature, into heat transfer relationship with said first mass of sand to heat said first mass to said treatment temperature range and maintaining the first mass in said treatment temperature range for at least a second predetermined time to treat the first mass.

8. A method according to claim 7 wherein the second mass is fluidised whilst it is at said temperature above said first predetermined temperature.

9. A method according to claim 7 wherein said feeding into heat transfer relationship comprises mixing the, or part of the the, second mass with the first mass.

10. A method according to claim 7 wherein said first predetermined temperature lies in the range 430° C. to 600° C. and said second predetermined temperature lies in the range 250° C. to 600° C.

11. A method according to claim 7 wherein said first predetermined time lies in the range 0.1 hours to 1 hour.

12. A method according to claim 7 wherein the second mass is heated using electrical heating means.

13. A method according to claim 1 wherein the method comprises an initial step of attriting the used sand.

14. Foundry stand when treated by the method as claimed in claim 1.

15. A method of casing metal comprising the steps of making a mould using reclaimed used foundry sand and an organic binder, casing molten metal into said mould to make a casting, separating used sand from the casting, reclaiming the sand and then reusing the reclaimed sand to make a further mould wherein the used sand is reclaimed by a method as claimed in claim 1.

16. A method according to claim 15 wherein the metal is a non-ferrous metal.

17. A method according to claim 16 wherein the sand is zircon sand.

18. An apparatus for heat treating granular material comprising a first treatment station, first delivery means to deliver a first mass of granular material to the first treatment station, a second treatment station, second delivery means to deliver a second mass of granular material to the second treatment station, heating means to heat said second mass of material at the second treatment station, third delivery means to deliver at least part of the heated second mass from the second treatment station to the first treatment station to mix with the first mass so that, in use, the temperature of the material of the first treatment station lies in the range 250° C. to below 400° C., means to supply combustion supporting gas to the first treatment station to percolate through the material thereat, and fourth delivery means to permit the mixed together mass to be withdrawn from the first treatment station.

19. An apparatus according to claim 18 wherein the second treatment station comprises a container to which said second mass is fed and means to fluidise said second mass when in said container.

20. An apparatus according to claim 19 wherein said heating means comprises an electrical heating means to heat the fluidised second mass in said container.

21. An apparatus according to claim 18 wherein a heat exchanger is provided at the exit of the first treatment station whereby material leaving the station is cooled.

22. An apparatus according to claim 18 wherein the first treatment station comprises a stationary container of tonnage volume into which both said first and second masses are fed and are maintained therein without agitation.

23. An apparatus according to claim 18 wherein said apparatus further comprises a storage hopper having two outlets, means to feed granular material to provide said second mass from one outlet and means to feed granular material to provide the first mass from the other outlet.

24. An apparatus according to claim 18 wherein the apparatus includes an attrition means to attrite the used sand prior to being fed to the first and second treatment station.

25. An apparatus according to claim 18 wherein the apparatus is a metal casting plant including a mould making station, whereat moulds are made using reclaimed used foundry sand and organic binder, a casting station whereat a mould is filled with molten metal, a knock-out means, a means to feed knocked-out sand to said first and second treatment stations to reclaim said sand and means to feed reclaimed sand from the first treatment station to said mould making station.

* * * * *

UNITED STATES PATENT AND TRADEMARK OFFICE

CERTIFICATE OF CORRECTION

PATENT NO. : 4,437,834

DATED : March 20, 1984

INVENTOR(S) : Alfredo Vogel

It is certified that error appears in the above-identified patent and that said Letters Patent are hereby corrected as shown below:

Abstract, line 6, "240°" should be --250°--.

Column 2, line 36, "sand" should be --said--.

Column 2, line 48, "head" should be --heat--.

Column 3, line 56, "furnane" should be --furane--.

Column 7, line 48, "silot" should be --silo--.

Signed and Sealed this

*Twenty-first* Day of *August 1984*

[SEAL]

*Attest:*

GERALD J. MOSSINGHOFF

*Attesting Officer*

*Commissioner of Patents and Trademarks*